US009028680B2

(12) United States Patent
Dieckmann et al.

(10) Patent No.: US 9,028,680 B2
(45) Date of Patent: May 12, 2015

(54) METHOD AND SYSTEM FOR PROCESSING VISCOUS LIQUID CRUDE HYDROCARBONS

(75) Inventors: Gunther Hans Dieckmann, Walnut Creek, CA (US); John Segerstrom, Oxnard, CA (US); Cesar Ovalles, Walnut Creek, CA (US); Estrella Rogel, Orinda, CA (US); Vasudevan Sampath, Houston, TX (US); Donald L. Kuehne, Hercules, CA (US); Hariprasad Janakiram Subramani, Houston, TX (US); Dennis John O'Rear, Penngrove, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 663 days.

(21) Appl. No.: 12/904,618

(22) Filed: Oct. 14, 2010

(65) Prior Publication Data

US 2012/0090220 A1 Apr. 19, 2012

(51) Int. Cl.
*C10G 1/00* (2006.01)
*C10G 21/00* (2006.01)

(52) U.S. Cl.
CPC ..... *C10G 21/003* (2013.01); *C10G 2300/308* (2013.01); *C10G 2300/802* (2013.01)

(58) Field of Classification Search
CPC ..... C10F 21/003; C10F 21/00; B01J 2/006; G23D 11/10
USPC ..... 208/86, 309, 311–317, 39, 44, 370; 427/212; 239/416.4, 416.5, 423, 424; 222/630, 637; 137/13
See application file for complete search history.

(56) References Cited

U.S. PATENT DOCUMENTS

| | | | | |
|---|---|---|---|---|
| 3,026,568 | A * | 3/1962 | Moar | 264/7 |
| 3,235,483 | A * | 2/1966 | McCoy et al. | 208/39 |
| 4,392,944 | A | 7/1983 | Kessick | |
| 4,522,627 | A * | 6/1985 | Gomi et al. | 44/502 |
| 5,526,839 | A | 6/1996 | Padron | |
| 6,187,172 | B1 | 2/2001 | Plummer | |
| 6,357,526 | B1 | 3/2002 | Abdel-Halim et al. | |
| 6,802,897 | B1 | 10/2004 | Lackey et al. | |
| 7,101,499 | B1 * | 9/2006 | Bronicki et al. | 264/11 |
| 2004/0216492 | A1 | 11/2004 | Ganan-Calvo et al. | |
| 2004/0232051 | A1 | 11/2004 | Varadaraj | |
| 2006/0118467 | A1 | 6/2006 | Argillier et al. | |
| 2008/0054100 | A1 | 3/2008 | Rosell et al. | |

FOREIGN PATENT DOCUMENTS

WO WO 2006/061482 6/2006

OTHER PUBLICATIONS

James G. Speight, "Petroleum processing and refining," in Access-Science, © McGraw-Hill Education, 2012, http://www.access-science.com, pp. 3-4.*

* cited by examiner

*Primary Examiner* — Michelle Stein
(74) *Attorney, Agent, or Firm* — Richard J. Schulte

(57) ABSTRACT

A method and system for handling viscous liquid crude hydrocarbons is disclosed. The method involves (a) solvent deasphalting at least a portion of an asphaltene-containing liquid crude hydrocarbon feedstock to form an asphaltene fraction and a deasphalted oil (DAO) fraction essentially free of asphaltenes; (b) adjusting the density of the asphaltene fraction to substantially the same density of a carrier for the asphaltene fraction; (c) forming coated asphaltene particles from the asphaltene fraction of step (b); (d) slurrying the coated asphaltene particles with the carrier; and (e) transporting the slurry to a treatment facility or a transportation carrier.

17 Claims, 5 Drawing Sheets

METHOD AND SYSTEM FOR PROCESSING VISCOUS LIQUID CRUDE HYDROCARBONS

BACKGROUND OF THE INVENTION

1. Technical Field

The present invention generally relates to a method and system for processing viscous liquid crude hydrocarbons.

2. Description of the Related Art

As world reserves of light, sweet crudes diminish and worldwide consumption of oil increases, refiners seek methods for extracting useful oils from heavier crude resources. Extensive reserves in the form of "heavy crudes" exist in a number of countries, including Western Canada, Venezuela, Russia, the United States, and elsewhere. For example, heavy or extra heavy crude oil can be found in the Orinoco Belt in Venezuela, the oil sands in Canada, and the Ugnu Reservoir in Northern Alaska. Alberta produces approximately two-thirds of Canada's oil and more than three-quarters of its natural gas. Nearly half of Alberta's oil is mined from vast oil sands, which contain deposits of a heavy crude oil called bitumen. Alberta's oil sands represent the largest known deposits of bitumen in the world. The oil sands occur in three major areas of the province: the Athabasca River Valley in the northeast, the Peace River area in the north, and the Cold Lake region in east central Alberta.

The heavier crudes, which can include bitumens, heavy oils and tar sandspose processing problems due to significantly higher concentration of contaminants such as sulfur and nitrogen as well as metals, most notably iron, nickel and vanadium. Bitumen is more costly to mine than conventional crude oil, which flows naturally or is pumped from the ground. This is because the thick black oil must be separated from the surrounding sand and water to produce a crude oil that can be further refined. The bitumen, which contrary to normal crude found in a deep reservoir, does not have the same light fractions normal crude. The bitumen thus consists of heavy molecules with a density exceeding 1.000 kg/dm$^3$ (less than 10 API gravity) and a viscosity at reservoir conditions 1000 times higher than light crude. Because of the composition of the bitumen, it has to be upgraded before it can be refined in a refiner as light crude.

The large reserves of heavy or extra heavy crude oil are very viscous in their natural state. The viscous nature of the crude oil, however, makes it difficult to transport the oil in conventional pipelines to stations where it can be processed into useful end products. The origin of high viscosity in these oils has been attributed to high asphaltene content of the oils. Asphaltenes are organic heterocyclic macromolecules which occur in crude oils. Under normal reservoir conditions, asphaltenes are usually stabilized in the crude oil by maltenes and resins that are chemically compatible with asphaltenes, but that have lower molecular weight. Polar regions of the maltenes and resins surround the asphaltene while non-polar regions are attracted to the oil phase. Thus, these molecules act as surfactants and result in stabilizing the asphaltenes in the crude. However, changes in pressure, temperature or concentration of the crude oils can alter the stability of the dispersion and increase the tendency of the asphaltenes to agglomerate into larger particles. As these asphaltene agglomerates grow, so does their tendency to precipitate out of solution.

Generally, unwanted asphaltene precipitation is a concern to the petroleum industry due to, for example, plugging of an oil well or pipeline as well as stopping or decreasing oil production. Also, in downstream applications, asphaltenes are believed to be the source of coke during thermal upgrading processes thereby reducing and limiting yield of residue conversion. Viscosity reduction of heavy oils is therefore important in production, transportation and refining operations of the oil. Accordingly, transporters and refiners of heavy crude oil have developed different techniques to reduce the viscosity of heavy crude oils to improve its pumpability.

One solution has been to form oil-in-water emulsions. Oil-in-water emulsions exhibit greatly reduced viscosity which facilitates its transport through a pipeline. For example, U.S. Pat. No. 4,392,944 ("the '944 patent") discloses a stable oil-in-water emulsion of heavy crude oil and bitumen and subsequent breaking of the emulsion. The '944 patent discloses that the emulsion can be broken by conversion of the oil-in-water emulsion into a water-in-oil emulsion using calcium hydroxide (i.e., slaked lime or hydrated lime) and dewatering of the resulting water-in-oil emulsion. Another example is U.S. Pat. No. 5,526,839 which discloses a method for forming a stable emulsion of a viscous crude hydrocarbon in an aqueous buffer solution, involving the steps of (a) providing a viscous crude hydrocarbon containing an inactive natural surfactant; (b) forming a solution of a buffer additive in an aqueous solution to provide a basic aqueous buffer solution, wherein the buffer additive activates the inactive natural surfactant from the viscous crude hydrocarbon; and (c) mixing the viscous crude hydrocarbon with the aqueous buffer solution at a rate sufficient to provide a stable emulsion of the viscous crude hydrocarbon in the aqueous buffer solution.

Another solution has been the use of ultrasonic irradiation to alter the asphaltene fraction. For example, U.S. Patent Application Publication No. 2004/0232051 discloses a process of sonicating a starting heavy oil in the presence of an acid selected from the group consisting of mineral acids, organic acids and mixtures thereof in the absence of hydrotreating conditions to produce a decreased viscosity heavy oil composition comprising a dispersed phase of asphaltene salts of acids wherein the acids are selected from the group consisting of mineral acids, organic acids, and mixtures thereof in a hydrocarbon continuous phase.

Yet another solution is the use of dispersants to disassemble or break up the agglomerates of asphaltenes in the oil. For example, U.S. Pat. No. 6,187,172 discloses a method for dispersing asphaltenes in a liquid hydrocarbon by incorporating into the liquid hydrocarbon a sufficient concentration, e.g., about 0.1 to about 25 weight percent, of a hydrocarbon soluble asphaltene dispersant.

Asphaltene-containing liquid crude hydrocarbon feedstocks which are unacceptable for transportation impart a low economic value to the unacceptable feedstock. Accordingly, it would be desirable to provide improved methods and systems for processing and transporting asphaltene-containing viscous liquid crude hydrocarbons that can be carried out in a simple, cost efficient manner.

SUMMARY OF THE INVENTION

In accordance with one embodiment of the present invention, there is provided a method comprising the steps of:

(a) solvent deasphalting at least a portion of an asphaltene-containing liquid crude hydrocarbon feedstock to form an asphaltene fraction and a deasphalted oil (DAO) fraction essentially free of asphaltenes;

(b) adjusting the density of the asphaltene fraction to substantially the same density as the density of a carrier for the asphaltene fraction;

(c) forming coated asphaltene particles from the asphaltene fraction of step (b);

(d) mixing the coated asphaltene particles with the carrier to form a slurry; and (e) transporting the slurry to a treatment facility or a transportation carrier.

In accordance with a second embodiment of the present invention, there is provided a system comprising:

(a) a solvent deasphalting unit for separating an asphaltene-containing liquid crude hydrocarbon feedstock into an asphaltene fraction and a deasphalted oil (DAO) fraction essentially free of asphaltenes;

(b) a density adjusting unit for adjusting the density of the asphaltene fraction to substantially the same density as the density of a carrier for the asphaltene fraction;

(c) one or more units for forming coated asphaltene particles from the asphaltene fraction of step (b);

(d) a slurrying unit for mixing the coated asphaltene particles with the carrier to form a slurry; and (e) a transportation unit for transporting the slurry to a treatment facility or a transportation carrier.

The method and system of the present invention advantageously process an asphaltene fraction of an asphaltene-containing liquid crude hydrocarbon feedstock such that the asphaltene fraction can be more easily handled and transported in a simple, cost efficient manner to a desired location such as a treatment facility for various end processing or to a transportation carrier for further transportation to, for example, a refinery.

DETAILED DESCRIPTION OF THE INVENTION

Figure 1:
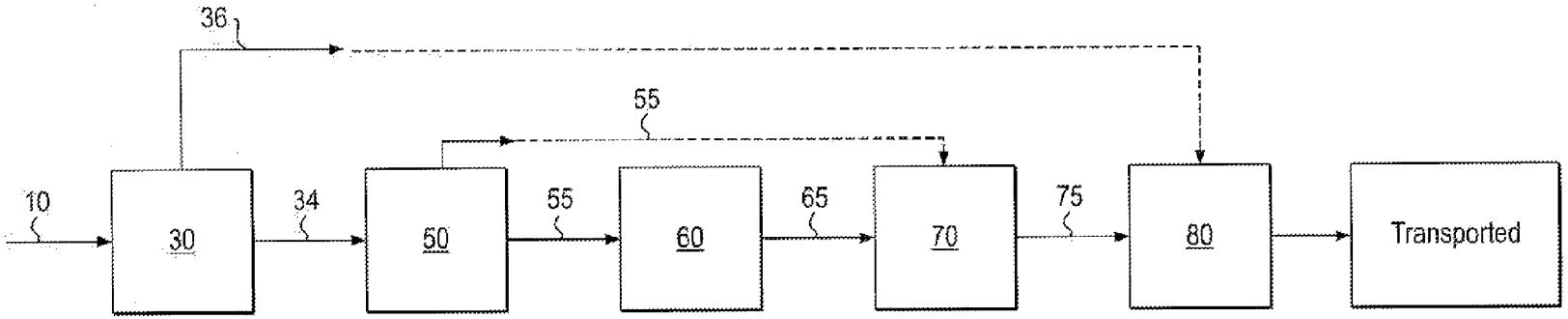
FIG. 1 is a schematic flow diagram of a production and processing scheme for an asphaltene-containing liquid crude hydrocarbon feedstock according to one embodiment of the present invention.

The present invention is directed to a method and system for processing an asphaltene-containing liquid crude hydrocarbon feedstock. Generally, the method involves the steps of (a) solvent deasphalting at least a portion of an asphaltene-containing liquid crude hydrocarbon feedstock to form an asphaltene fraction and a deasphalted oil (DAO) fraction essentially free of asphaltenes; (b) adjusting the density of the asphaltene fraction to substantially the same density as the density of a carrier for the asphaltene fraction; (c) forming coated asphaltene particles from the asphaltene fraction of step (b); (d) mixing the coated asphaltene particles with the carrier to form a slurry; and (e) transporting the slurry to a treatment facility or a transportation carrier.

Asphaltenes, sometimes also referred to as asphalthenes, are a solubility class of compounds, generally solid in nature and comprise polynuclear aromatics present in the solution of smaller aromatics and resin molecules, and are also present in the crude oils and heavy fractions in varying quantities. Asphaltenes do not usually exist in all of the condensates or in light crude oils; however, they are present in relatively large quantities in heavy crude oils and petroleum fractions. Asphaltenes are insoluble components or fractions and their concentrations are defined as the amount of asphaltenes precipitated by addition of an n-paraffin solvent to the feedstock which are completely soluble in aromatic solvents, as prescribed in the Institute of Petroleum Method IP-143.

Generally, the source of the produced viscous asphaltene-containing liquid crude hydrocarbon may be any source where from a hydrocarbon crude may be obtained, produced, or the like. The source may be one or more producing wells in fluid communication with a subterranean oil reservoir. The producing well(s) may be under thermal recovery conditions, or the producing well(s) may be in a heavy oil field where the hydrocarbon crude or oil is being produced from a reservoir having a strong water-drive.

In one embodiment, the asphaltene-containing liquid crude hydrocarbon includes a heavy crude oil, bitumens and combinations thereof. Crude oil is any type of crude oil or petroleum and may also include liquefied coal oil, tar sand oil, oil sand oil, oil shale oil, Orinoco tar or mixtures thereof. The crude oil includes crude oil distillates, hydrocarbon oil residue obtained from crude oil distillation or mixtures thereof.

In one embodiment, an asphaltene-containing liquid crude hydrocarbon feedstock is a heavy crude oil. The term "heavy crude oil" as used herein refers to a crude oil having an API gravity less than about 20 and a viscosity greater than about 100 centistokes (cSt) at 40° C. Examples of a heavy crude oil include Hamaca bitumen crude oil. A heavy crude oil has a relatively high asphaltene content with a relatively low hydrogen/carbon ratio. In one embodiment, the heavy crude oil has a pentane-insoluble asphaltene content of no more than about 20 wt. %. In one embodiment, a heavy crude oil is a crude oil having an API gravity less than about 20 and a viscosity greater than about 100 cSt and no more than 2,000,000 cSt at 40° C.

In another embodiment, an asphaltene-containing liquid crude hydrocarbon feedstock is an extra heavy crude oil. The term "extra heavy crude oil" as used herein refers to a crude oil having an API gravity less than about 12 and a viscosity greater than about 300 cSt at 40° C. In one embodiment, an extra heavy crude oil is a crude oil having an API gravity less than about 12 and a viscosity greater than about 300 cSt and no more than 2,000,000 cSt at 40° C.

Figure 2:
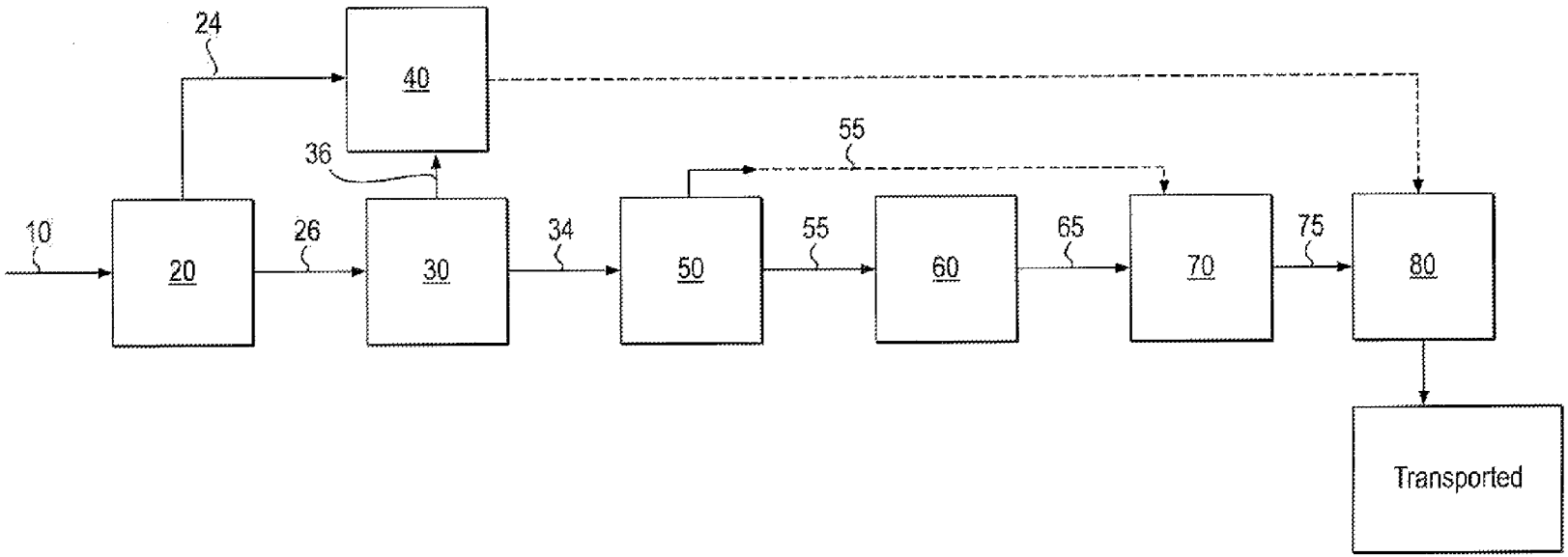
FIG. 2 is a schematic flow diagram of a production and processing scheme for an asphaltene-containing liquid crude hydrocarbon feedstock according to another embodiment of the present invention.

FIGS. 1 and 2 illustrate one of the process schemes for the processing of asphaltene-containing liquid crude hydrocarbons so as to easily transport the liquid crude hydrocarbons to a desired location, e.g., a treatment facility for various end processing or to a transportation carrier for further transportation to another location. The source of the asphaltene-containing liquid crude hydrocarbon feedstock 10 can first be passed through a conventional water-oil separator (not shown) which separates the produced fluids to obtain an asphaltene-containing liquid crude hydrocarbon feedstock 10 essentially free of water. The asphaltene-containing liquid crude hydrocarbon feedstock 10 is fed to solvent deasphalting unit 30 (SDA) to separate an asphaltene fraction 34 and a deasphalted oil (DAO) fraction 36 essentially free of asphaltenes. The term "essentially free" as used herein shall be understood to mean trace amounts, if any, of that component, e.g., an amount less than about 0.1 weight percent of that component.

The solvent deasphalting unit 30 can be any conventional unit, employing equipment and methodologies for solvent deasphalting which are widely available in the art, for example, under the trade designations ROSE, SOLVAHL, DEMEX, MDS and the like. By selecting the appropriate operating conditions of the solvent deasphalting unit 30, the properties and contents of the asphaltene fraction 34 and the DAO fraction 36 can be adjusted. The solvent deasphalting unit 30 contacts the feedstock 10 with a suitable solvent to separate the asphaltene fraction 34 from the DAO fraction 36 (and/or resins). Suitable solvents include, by way of example, one or more alkane solvents such as, for example, propane, butane, pentane, hexane, or a combination thereof, and the like.

If desired, prior to feeding feedstock 10 to solvent deasphalting unit 30, feedstock 10 can be subjected to one or more pretreatments to remove any lighter fraction or impurities thereby improving the concentration of the feedstock to allow for less solvent in the SDA. For example, feedstock 10 can be fractionated in distillation unit 20 such as an atmospheric distillation column and/or vacuum distillation column to produce a fractionated stream 24 such as a naphtha and a fractionated asphaltene-containing liquid crude hydrocarbon feedstock 26 (see FIG. 2). Products from the atmospheric distillation column include, by way of example, methane, ethane, propanes, butanes and hydrogen sulfide, naphtha (36 to 180° C.), kerosene (180 to 240° C.), gas oil (240 to 370° C.) and atmospheric residue, which are the hydrocarbon fractions boiling above 370° C. The atmospheric residue from the atmospheric distillation column can either be used as fuel oil or sent to a vacuum distillation unit, depending upon the configuration of the refinery. Products from the vacuum distillation column include, by way of example, vacuum gas oil comprising hydrocarbons boiling in the range 370 to 520° C., and vacuum residue comprising hydrocarbons boiling above 520° C. The fractionated stream 24 generally has a relatively lower viscosity than the fractionated asphaltene-containing liquid crude hydrocarbon feedstock 26.

The DAO fraction 36 can be blended in mixing unit 40 with the fractionated residue 24 to yield a blend which is a pumpable synthetic crude with, for example, a reduced sulfur and metal content by virtue of the fact that the asphaltene fraction 34 has been separated from the DAO fraction 36. The blend thus has higher value as an upgraded product.

Next, the asphaltene fraction 34 is passed to density adjusting unit 50 to adjust the density of asphaltene fraction 34 to substantially the same density as the density of a carrier for the asphaltene fraction such as the DAO fraction 36 or wastewater, i.e., the carrier used in forming the slurry as discussed herein below, and provide density adjusted asphaltene fraction 55. The term "to substantially the same density as" as used herein shall be understood to mean that the density of asphaltene fraction is adjusted to a resulting density which is relatively the same density as the carrier of the asphaltene fraction such that the coated asphaltene particles when mixed with the carrier to form a slurry will be stable in the carrier and transportable to the desired location with minimal settling or flotation problems. One skilled in the art can determine such a density based on such factors as, for example, the pipeline used, shipping requirement, etc. In one embodiment, the density of the asphaltene fraction is adjusted to within about 10% of the density of the carrier for the asphaltene fraction. In another embodiment, the density of the asphaltene fraction is adjusted to within about 5% of the density of the carrier for the asphaltene fraction. In another embodiment, the density of the asphaltene fraction is adjusted to within about 3% of the density of the carrier for the asphaltene fraction.

Density is generally the inverse measure of API gravity. Thus, the higher the density of the carrier, the lower the API gravity. The density of the carrier can readily be determined by one skilled in the art using for example, either a hydrometer, detailed in ASTM D1298 or with an oscillating U-tube method detailed in ASTM D4052. Without wishing to be bound by any theory, it is believed that by adjusting the density of the asphaltene fraction 34 to be substantially the same density as the density of a carrier for the asphaltene fraction, the density of the subsequent coated asphaltene particles will be substantially the same as the density of the carrier thereby allowing the coated asphaltene particles to be stabilized in the carrier. This, in turn, will minimize or avoid any settling and/or floatation problems with the coated asphaltene particles in the carrier during transportation of the product to its desired location, e.g., a treatment facility for various end processing or to a transportation carrier.

In one embodiment, the density of the asphaltene fraction 34 can be adjusted by introducing a supply of a gas to asphaltene fraction 34 for a time period sufficient to adjust the density of the asphaltene fraction 34 to substantially the same density of the desired carrier. Suitable gases for use herein include, but are not limited to, air, or an inert gas such as argon, carbon dioxide, nitrogen, methane, natural gas and the like and mixtures thereof. Generally, density adjusting unit 50 can include an inlet for introducing gas, a gas supply capable of maintaining constant flow, and a flow meter for measuring the flow rate of the gas to the asphaltene fraction 34.

The supply of gas can be mixed with asphaltene fraction 34 under high shear conditions to produce a dispersion of droplets or gas bubbles trapped in the asphaltene fraction 34. As used herein, the term "dispersion" refers to a liquefied mixture that contains at least two distinguishable substances (or "phases") that will not readily mix and dissolve together, i.e., a "dispersion" can include a "continuous" phase (or "matrix"), which holds therein discontinuous droplets, bubbles, and/or particles of the other phase or substance. The droplets or gas bubbles should be of a size which is smaller than the ultimate particle size of the asphaltene fraction 34. Generally, the droplets or gas bubbles in the dispersion will have an average diameter of about 1 micron up to about 500 microns in diameter.

In general, density adjusting unit 50 can include an external high shear mixing device (HSD), also sometimes referred to as a high shear device or high shear mixing device, which is configured for receiving an inlet stream containing the gas and asphaltene fraction 34. Alternatively, HSD may be configured for receiving the gas and asphaltene fraction 34 via separate inlet lines (not shown). Although only one high shear device can be used, it should be understood that some embodiments of the system may have two or more high shear mixing devices arranged either in series or parallel flow depending on the capacity of the HSD and the process stream flow rate requirements. HSD in this case is a mechanical device that utilizes one or more generators comprising a rotor/stator combination, each of which has a gap between the stator and rotor. The gap between the rotor and the stator in each generator set may be fixed or may be adjustable. The number of blades/vanes in the rotor and its geometry and configuration is a factor in imparting shear on process fluids. Generally, HSD is configured in such a way that it is capable of producing submicron and micron-sized bubbles in a reactant mixture flowing through the high shear device. The rotor and stator assembly is usually enclosed in an enclosure or housing so that the pressure and temperature of the reaction mixture may be controlled.

High shear mixing devices are generally divided into three general classes, based upon their ability to mix fluids. Mixing is the process of reducing the size of dispersed particles or inhomogeneous species and dispersing it homogeneously in the continuous fluid. One metric for the degree or thoroughness of mixing is the energy density per unit volume that the mixing device generates to disrupt the fluid particles. The classes are distinguished based on delivered energy densities. Three classes of industrial mixers having sufficient energy density to consistently produce mixtures or emulsions with particle sizes in the range of submicron to 50 microns include homogenization valve systems, colloid mills and high speed mixers. In the first class of high energy devices, referred to as homogenization valve systems, process fluid is pumped under very high pressure through a narrow-gap in the valve into a lower pressure environment. The pressure gradients across the valve and the resulting turbulence and cavitation act to break-up and disperse the bubbles in the fluid.

Other examples of high energy high shear devices include, but are not limited to, specifically designed cavitation systems where high pressure liquid and gas is injected through a narrow orifice to produce severe cavitation. Alternatively, a sonication horn can be used to disperse and breakdown larger sized gas bubbles into the desired range.

At the opposite end of the energy density spectrum are the low energy devices. These systems usually have paddles or fluid rotors that turn at high speed in a reservoir of fluid to be processed. These low energy systems are customarily used when average particle sizes of greater than 20 microns are acceptable in the processed fluid. Between the low energy devices and homogenization valve systems, in terms of the mixing energy density delivered to the fluid, are colloid mills and other high speed rotor-stator devices, which are classified as intermediate energy devices. A typical colloid mill configuration includes a conical or disk rotor that is separated from a complementary, liquid-cooled stator by a closely-controlled rotor-stator gap, which is commonly between 0.0254 mm to 10.16 mm (0.001 to 0.40 inch). Rotors are usually driven by an electric motor through a direct drive or belt mechanism. Rotors have special blade configuration that are specifically designed to efficiently impart shear energy on the process fluids. As the rotor rotates at high rates (greater than 5000 rpm), it pumps fluid between the outer surface of the rotor and the inner surface of the stator (gap between the rotor and stator), and shear forces generated in the gap process the fluid. Many colloid mills with proper adjustment achieve average particle sizes of 0.1 to 25 microns in the processed fluid. These capabilities render colloid mills appropriate for a variety of applications including colloid and oil/water-based emulsion processing.

HSD is capable of highly dispersing or transporting the gas into asphaltene fraction 34, with which it would normally be immiscible, at conditions such that a dispersion of gas in continuous liquid phase is produced and exits density adjusting unit 50 to particle-forming unit 60 via line 55. High shear conditions suitable for forming the dispersion include a rotor rpm in the range of about 5000 to about 15000, pressures greater than about 100 psi (690 kPa) and temperature above about 60° C.

In one embodiment, the density of the asphaltene fraction 34 can be adjusted by encapsulating one or more gas bubbles of, for example, air, argon, carbon dioxide, nitrogen, methane, natural gas and mixtures thereof, in the asphaltene fraction 34 using a concentric spray nozzle arrangement to obtain a controlled amount of gas in the asphaltene fraction 34 wherein the gas and the asphaltene fraction streams flow through the inner and annulus tubes of the nozzle. The nozzle is operated at an elevated temperature to sustain flow of the highly viscous asphaltene residue material. In one embodiment, an elevated temperature is a temperature ranging from about 80° C. to about 300° C. The size of the gas-encapsulated bubbles and the frequency of generation can be controlled by varying the flow rates of the two fluid streams and temperature thereby changing the rheology of the fluid exiting the nozzle. Various concentric spray nozzle arrangements are known and include, for example, those disclosed in U.S. Patent Application Publication Nos. 20040216492 and 20080054100, the contents of which are incorporated by reference herein.

For example, the basic device or nozzle of this embodiment can have a plurality of different embodiments. However, each configuration will comprise a means for supplying a first fluid (preferably a gas) and a means for supplying a second fluid (preferably a liquid, i.e., asphaltene fraction 34) in a pressure chamber which surrounds at least an exit of the means for supplying a first fluid. The second fluid supply means and pressure chamber are positioned such that the flow-induced interaction resulting in encapsulation of the first fluid exiting the first fluid supply means by the second fluid exiting the supply chamber takes place. The exit opening of the pressure chamber is downstream of and is directly aligned with the flow path of the means for supplying the second fluid.

In general, the means for supplying a first fluid is often referred to as a cylindrical tube. However, the tube shape could be varied, e.g., oval, square, or rectangular, and can be of uniform cross section or tapered. For example, the exit of the first fluid supply means may be a slit defined by two walls or surfaces, and having a long dimension and a short dimension. The first fluid can be any suitable gas as discussed above, e.g., air, argon, carbon dioxide, nitrogen, methane, natural gas or mixtures thereof.

The second fluid is the asphaltene fraction 34. The two fluids are generally immiscible or mildly miscible. However, on some applications, violent focusing can be used to enhance mixing between two poorly miscible fluids or phases, thanks to the large interfacial area between the two phases of fluids that is created during violent focusing.

Figure 3:
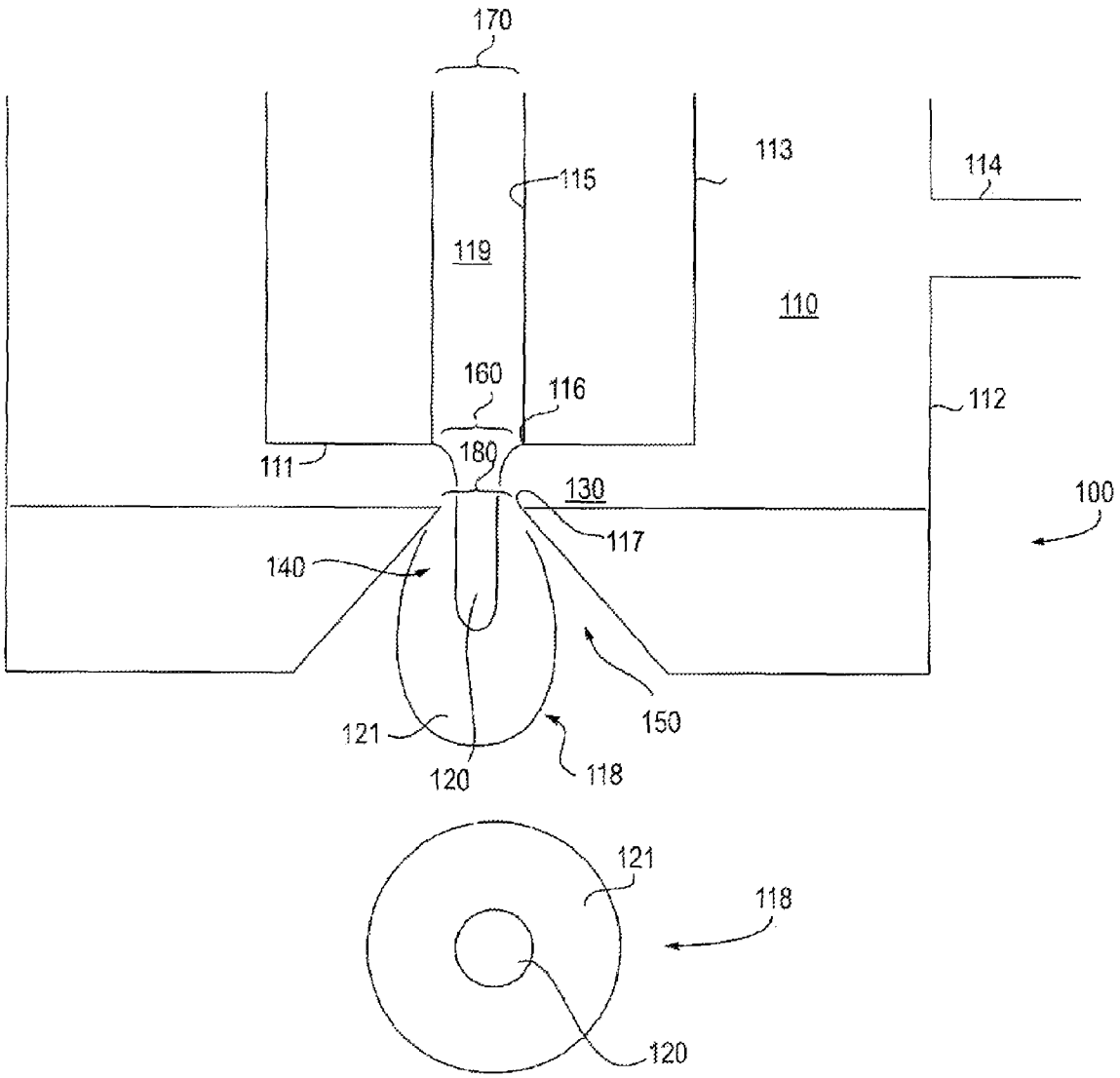
FIG. 3 is a schematic cross-sectional plan view of a nozzle for adjusting the density of the asphaltene fraction according to one embodiment of the present invention.

One embodiment for adjusting the density of the asphaltene fraction 34 using a concentric spray nozzle arrangement is generally depicted in FIG. 3. Referring to FIG. 3, a cross-sectional schematic view of the nozzle 100 is shown. The nozzle 100 is comprised of two basic components which include the pressure chamber 112 and the first fluid supply means 113. The pressure chamber 112 is pressurized by a second fluid 110 flowing into the pressure chamber via the entrance port 114. The first fluid supply means 113 includes an inner wall 115 defining an inner passage wherein a first fluid 119 flows. The first fluid supply means 113 can have any composition and configuration, including layers of dissimilar materials, voids, and the like, but is preferably a tube constructed of a single material. The inner wall 115 of the fluid supply means 113 is preferably supplied with a continuous stream of the first fluid 119 which can be any fluid (liquid or gas) but is preferably any gas as discussed above.

The pressure chamber 112 is continuously supplied with a pressurized second fluid 110. The inner wall 115 of the first fluid supply means 113 includes an exit port 116. The pressurized chamber 112 includes an exit port 117, which marks the entrance to the discharge opening 150. The exit port 117 of the pressure chamber is positioned directly downstream of the flow of first fluid exiting the exit port 116. The pressure chamber 112 includes channel 130 surrounding the exit port 116 of supply means 113. A first fluid supply means exit 160, the channel 130, and an exit 180 of the pressure chamber 112 are configured and positioned so as to obtain two effects: (1) the dimensions of the stream exiting the first fluid 119 supply means 113 are reduced by the second fluid 110 exiting the channel so that a focused stream 140 is formed; and (2) the first fluid 119 exiting the first fluid supply means 113 and the second fluid 110 exiting the channel 130 undergo a flow-induced encapsulation process to form gas encapsulated asphaltene particles 118. In other words, the flow-induced encapsulation process forms asphaltene particles 118 each having a gas voids or bubbles 120 encapsulated in a layer of asphaltene 121.

The position of the exit port 180 can be in any location that allows the efficient encapsulation of the first fluid by the second fluid and efficiently delivers the resulting asphaltene particles 118 to coating unit 70 as discussed below. In one embodiment, the exit port 180 of the chamber 112 is substantially directly aligned with the flow of first fluid exiting the first fluid supply means 113. The desired formation of asphaltene particles 118 is obtained by correctly positioning and proportioning the various components of the first fluid supply means 113 and the pressure chamber 112 and thus correctly proportioning the channel 130 as well as the properties of the fluids, including, but not limited to, the pressure, viscosity, density and the like, determining the mass flow, momentum flow, and energy flow of the first fluid which flows out of both the first fluid supply means 113, of the second fluid which flows through the channel 130, and of the resultant coaxial flow stream of first and second fluids that flow out of exit 180, the result being the creation of asphaltene particles 118.

The first fluid 119 is held within an inner wall 115 that is cylindrical in shape. However, the inner wall 115 holding the first fluid 119 may be tapered (e.g., funnel shaped) or have other varying cross section, asymmetric, oval, square, rectangular or in other configurations including a configuration which would present a substantially planar flow of first fluid 119 out of the exit port 160. Thus, the nozzle applies to all kinds of configurations that have a channel for the second fluid 110 surrounding the first fluid means exit 160.

The focusing of the stream of first fluid 119 and the ultimate particle formation are based on the encapsulation of the first fluid 119 on passing through and out of exit 160 and through exit 180 by the second fluid 110 which is contained in the pressure chamber 112.

In another embodiment, the density of the asphaltene fraction 34 can be adjusted by mixing a sufficient amount of one or more density adjusting additives with asphaltene fraction 34 to adjust the density of the asphaltene fraction 34 to substantially the same density as the desired carrier and then sent to particle-forming unit 60. Density adjusting additives can be any solid additive having a density less than 1 g/mL or kg/L. In one embodiment, one or more density adjusting additives can be any solid additive having a density less than 1 g/mL and more preferably less than 0.85 g/mL. Suitable density adjusting additives include, but are not limited to, sawdust, chipped wood, polymer-containing solid, waste construction materials, bio-derived waste, bio-char, and the like and mixtures thereof. Generally, a sufficient amount of the one or more density adjusting additives can range from about 1 wt. % to about 50 wt. %.

Once the density of the asphaltene fraction 34 has been adjusted, density adjusted asphaltene fraction 55 is passed through one or more units for providing coated asphaltene particles from the density adjusted asphaltene fraction. As discussed above, in the case where the density of the asphaltene fraction 34 was adjusted by forming gas encapsulating asphaltene particles 118, these particles can be used as is and therefore directly sent to coating unit 70, as discussed below. In other words, density adjusted asphaltene fraction 55 will be sent from unit 50 directly to coating unit 70 as shown in FIGS. 1 and 2.

In the case where it is necessary to form particles from the density adjusted asphaltene fraction 55, the density adjusted asphaltene fraction 55 is sent to particle-forming unit 60. The resulting particles obtained from particle-forming unit 60 can be of any suitable size, shape or form, for example, in the form of pellets or rods, that are capable of being coated and then transported in a slurry. In one embodiment, density adjusted asphaltene fraction 55 is first passed through particle-forming unit 60 for pelletizing the density adjusted asphaltene fraction into solid pellets. Any suitable pelletizing equipment known in the art can be used herein to form solid pellets of density adjusted asphaltene fraction 55. In general, the solid pellets of density adjusted asphaltene fraction 55 can have a particle size ranging from about 0.5 millimeter (mm) to about 10 mm in diameter. In another embodiment, the solid pellets of density adjusted asphaltene fraction 55 can have a particle size ranging from about 1 mm to about 5 mm in diameter.

In one preferred embodiment, density adjusted asphaltene fraction 55 is subjected to a prilling process for pelletizing the density adjusted asphaltene fraction into solid pellets. Prilling is well known in the art and refers to a process for pelletizing a solid material which includes melting the material and spraying the molten material, whereby droplets of the material solidify. Prilling involves the atomization of an essentially solvent free, molten purified feed material in counter-current flow with a cooling gas to cool and solidify the purified feed material. Typically, prilling is conducted at near ambient temperatures. In one embodiment, the density adjusted asphaltene fraction 55 is sprayed in a defined droplet size at the tip of a prilling tower, solidified in free fall, preferably through a cooling air or gas stream and the prills are obtained as particles at the bottom of the tower. If desired, water can also be sprayed into the asphaltene prilling tower to increase the rate of cooling as disclosed in, for example, U.S. Pat. No. 6,357,526.

Asphaltene particles in a transportable fluid can be made by contacting the hot asphaltene stream with a lower temperature turbulent second fluid such as cool or cold water, see, e.g., U.S. Pat. No. 7,101,499, the contents of which are incorporated by reference herein.

In another embodiment, the density adjusted asphaltene fraction 55 is passed through an extruder to produce long rods or extrudates. The hot density adjusted asphaltene rods can then be cooled by contacting the rods with a cooling air or water stream. Once cool and hard, the asphaltene rods can then be broken into shorter pieces. There are many technologies that can be used for reducing the size of the rods. In one example, the long asphaltene rods can be passed through a roller with a small radius. The diameter of the resulting rods can range from about 0.5 to about 10 mm; with lengths ranging from approximately 1× of the diameter to over 10× of the diameter of the rod. Once the rods of the desired length are formed, they can be coated.

The asphaltene particles 65 are then coated with a coating capable of preventing the coated asphaltene particles from re-dissolving in the carrier. In one embodiment, the coating is an inert coating material such as poly(methylmethacrylate), coker fines, sulfur, clay, silica and mixtures thereof. In another embodiment, the coating is an inert coating material such as one or more of a latex dispersion of poly(methylmethacrylate) in water, a mixture of poly(methylmethacrylate) and coke or a mixture of poly(methylmethacrylate) and sulfur and the like.

In one embodiment, the asphaltene particles 65 can also be coated employing any suitable coating technique known in the art such as, for example, spray coating, dip coating, gas deposition coating and the like. In one embodiment, coating unit 70 is a spray coating unit containing an application chamber through which the asphaltene particles to be treated are arranged to travel, the application chamber containing an inlet opening for leading the asphaltene particles into the application chamber and an outlet opening for leading the asphaltene particles out of the application chamber; at least one row of spray nozzles including at least one nozzle for spraying the coating material on the surface of the particles in the application chamber; and optionally spraying members for spraying water mist into the application chamber.

In another embodiment, coating unit 70 includes a means for contacting the asphaltene particles with a hot blast of an oxygen-containing gas sufficient to oxidize the outer surface of the asphaltene particles thereby forming a coating on the surface of the particles. A hot blast of an oxygen-containing gas can include a hot blast of air, steam and the like. For example, coating unit 70 can include an application chamber through which the asphaltene particles to be treated are arranged to travel, the application chamber containing an inlet opening for leading the particles into the application chamber and an outlet opening for leading the particles out of the application chamber; at least one row of nozzles including at least one nozzle for applying the hot blast gas on the surface of the asphaltene particles in the application chamber; and optionally another nozzle for applying a cooling stream. The coating unit 70 can also include a heating source for heating the gas such as a hot blast heater. Alternatively, the surface of the asphaltene particles can be treated by passing the particles through an oxygen containing plasma.

In one embodiment, the coating is formed during the pelletizing step. In general, the density adjusted asphaltene fraction 55 is passed through particle-forming unit 60 for pelletizing the asphaltene fraction into solid pellets and an inert coating material is added to, for example, the cooling stream during the prilling process. In one embodiment, the coating material is dispersed or dissolved into the cooling water used in the pelletizing processes as disclosed in, for example, U.S. Pat. Nos. 6,357,526 and 7,101,499.

The coated asphaltene particles 75 are then fed to slurrying unit 80 where the coated asphaltene particles are mixed with a carrier having substantially the same density as the coated asphaltene particles to form a slurry. Slurrying unit 80 includes a mixing zone for mixing the coated asphaltene particles with the carrier. In one embodiment, the carrier for mixing with the coated asphaltene particles is DAO fraction 36. In another embodiment, the carrier for mixing with the coated asphaltene particles is a blend of the DAO fraction 36 with the fractionated residue 24. In yet another embodiment, the carrier for mixing with the coated asphaltene particles is a wastewater from, for example, a well or from a refinery.

In one embodiment, the resulting slurry formed can have a solids content ranging from about 1 wt. % to about 20 wt. %. In another embodiment, the resulting slurry formed can have a solids content ranging from about 10 wt. % to about 30 wt. %.

Once the slurry has been formed, the slurry is then transported to its desired location such as a treatment facility or a transportation carrier. The slurry will be transported by a transportation means such as a railroad, truck, ship, or pipeline, in, for example, containers that include tanks, vessels, and containerized units. The desired location can be a treatment facility such as a refinery where the slurry is further processed. In one embodiment, the coated asphaltene particles can be separated from the slurry and sent to a hydroprocessing unit or to a refinery coker unit (e.g., delayed coking or fluidized coking unit) in which the coated asphaltene particles can be further processed into lighter hydrocarbons and petroleum coke. In another embodiment, the coated asphaltene pellets can be melted, mixed with the separated carrier fraction, e.g., the DAO fraction or DAO/naphtha fraction, and then subjected to further processing. In yet another embodiment, the separated carrier fraction, e.g., the DAO fraction or DAO/naphtha fraction, can be subjected to further processing.

Examples of further processing include using the product as a refinery feedstock in one or more crude hydrocarbon refining components within a refinery and subjected to one or more conventional hydroprocessing techniques such as hydrotreating, hydrocracking, hydrogenation, hydrofinishing and hydroisomerization and the like. Alternatively, one or more of the products can be blended with one or more different hydrocarbon-containing feedstocks. The refinery hydroprocessing techniques that the one or more of the selected hydrocarbon-containing feedstocks can be used in are well known in the art.

The term "crude hydrocarbon refinery component" generally refers to an apparatus or instrumentality of a process to refine crude hydrocarbons, such as an oil refinery process. Crude hydrocarbon refinery components include, but are not limited to, heat transfer components such as a heat exchanger, a furnace, a crude preheater, a coker preheater, or any other heaters, a FCC slurry bottom, a debutanizer exchanger/tower, other feed/effluent exchangers and furnace air preheaters in refinery facilities, flare compressor components in refinery facilities and steam cracker/reformer tubes in petrochemical facilities. Crude hydrocarbon refinery components can also include other instrumentalities in which heat transfer may take place, such as a fractionation or distillation column, a scrubber, a reactor, a liquid-jacketed tank, a pipestill, a coker and a visbreaker. It is understood that "crude hydrocarbon refinery components," as used herein, encompass tubes, piping, baffles and other process transport mechanisms that are internal to, at least partially constitute, and/or are in direct fluid communication with, any one of the above-mentioned crude hydrocarbon refinery components.

In another embodiment, once the slurry has been formed, the slurry is then transported to another transportation carrier to further transport the slurry to a desired location such as a refinery for further processing as described hereinabove. For example, the slurry can be transported through a pipeline to ship terminal where the slurry is then further transported on a ship to a desired refinery.

The following non-limiting examples are illustrative of the present invention.

Example 1

The methodology of this example is based on ASTM test Method D-6560 "Standard Test Method for Determination of Asphaltenes (Heptane Insolubles) in Crude Petroleum and Petroleum Products 1". A sample of the heavy crude oil is dissolved in a 20 times larger volume aliquot of hot normal heptane. The solution is stirred and digested at 80° C. for one hour. The solution is filtered through a 0.8-micron membrane filter, and the insoluble material is washed with hot heptane. The heptane is stripped by distillation under vacuum to yield the deasphalted oil (DAO).

Figure 4:
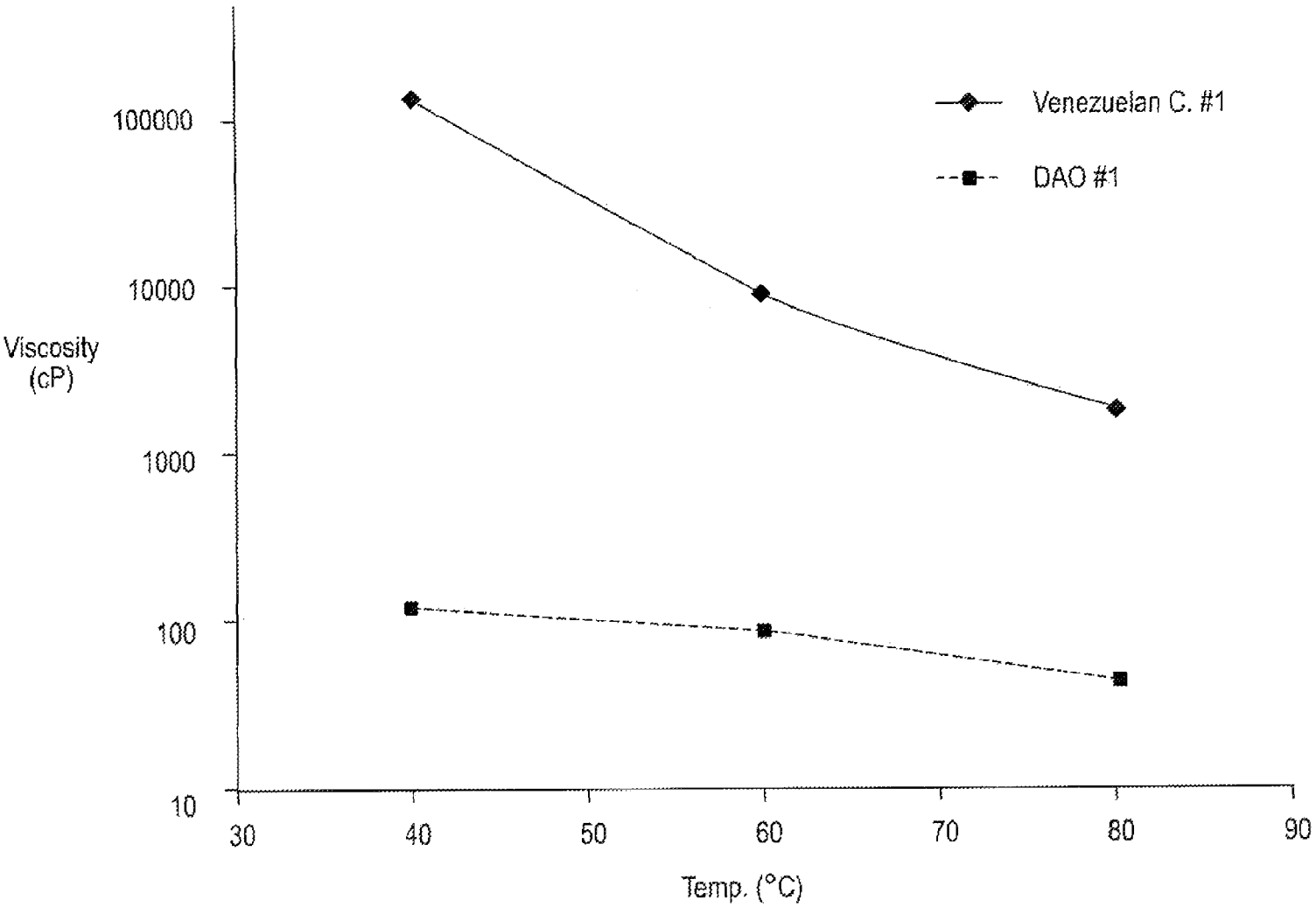
FIG. 4 shows the viscosity of Venezuelan Heavy Crude #1 and its DAO material.
Figure 5:
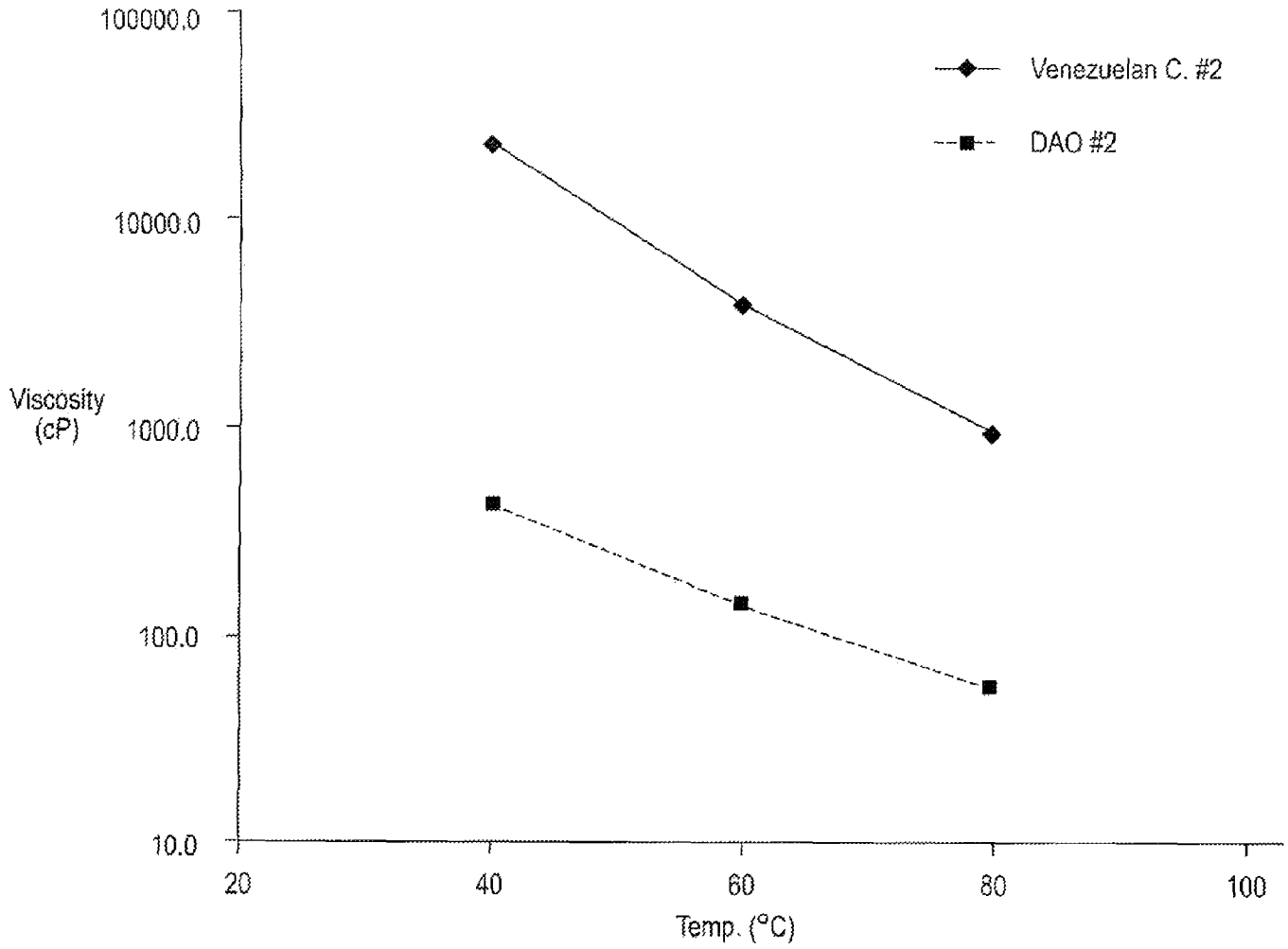
FIG. 5 shows the viscosity of Venezuelan Heavy Crude #2 and its DAO material.
Figure 6:
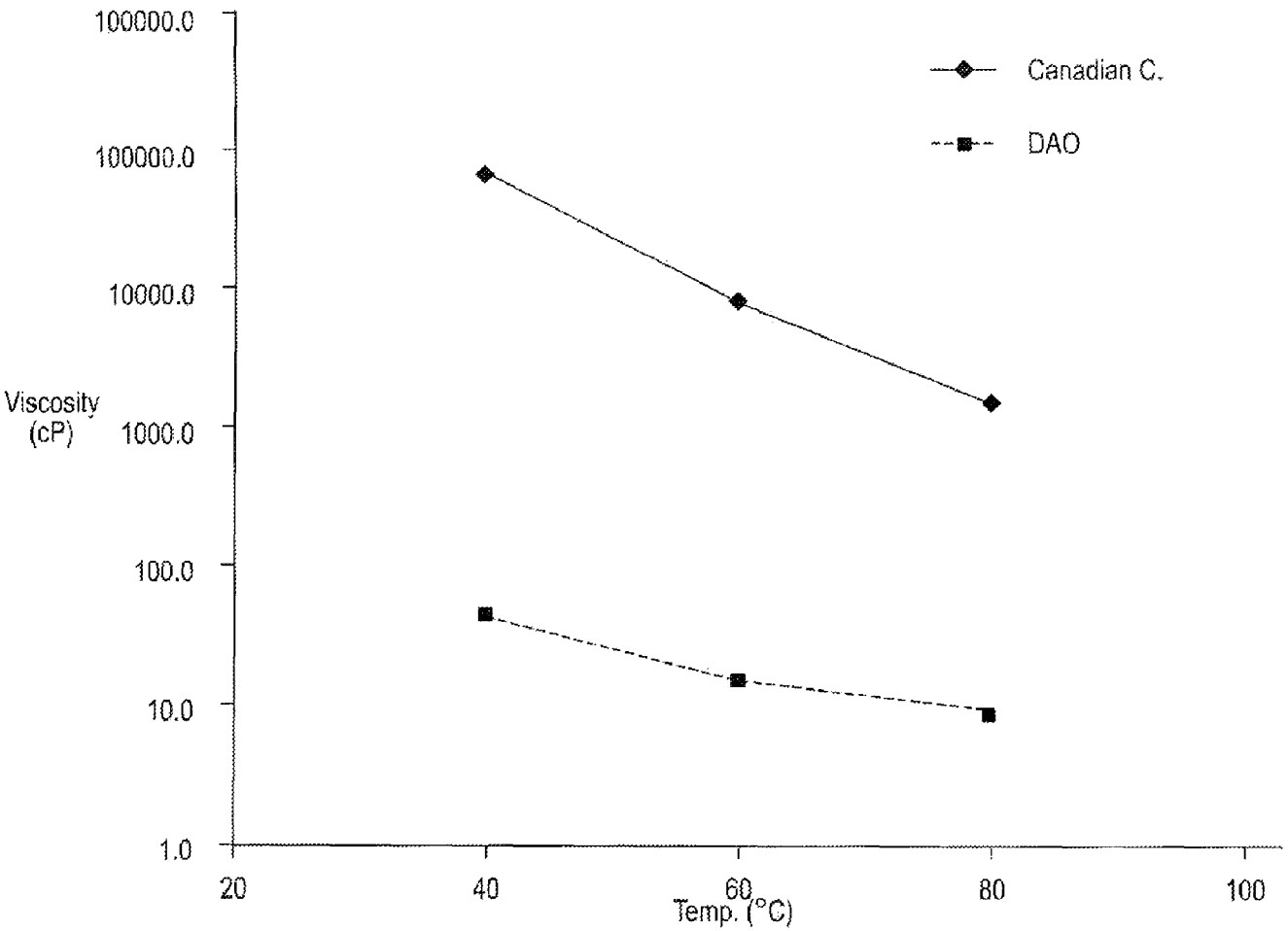
FIG. 6 shows the viscosity of Canadian Heavy Crude and its DAO material.

Three heavy crude oils were used and, as can be seen in the FIGS. 4-6, the viscosities of the DAOs were 2 to 3 order of magnitude lower than those measured by the original crude oil. These results indicate that by removing the asphaltenes from the heavy crude oils (continuous trace), a significant reduction on the viscosity of the DAO (discontinuous trace) were obtained over all the temperature range.

Example 2

An extra heavy crude oil from the field is desalted using standard technology known in the art, and then sent to an atmospheric still to produce naphtha or atmospheric gas oil (AGO) overhead cut and an atmospheric residue bottoms cut. The atmospheric residue is then solvent deasphalted in a conventional SDA/ROSE (solvent deasphalting/resid oil supercritical extraction) unit as described in Example 1. The resulting DAO is then blended with the atmospheric gas oil (AGO) from the crude still, while the hot SDA tar is sent to the density adjusting unit.

In the density adjusting unit, a stream of finely divided inert gas is injected under high pressure through a fine orifice into the hot SDA tar to create a fine dispersion of inert gas bubbles in the hot SDA tar stream. The amount of inert gas is closely controlled so that the density of the SDA tar/inert gas mixture matches that of the combined DAO and atmospheric gas oil cut.

The density adjusted hot SDA tar is sent to the pelletizing/coating unit. This resulting mixture is injected to a hot pressurized water vessel and then subjected to high shear conditions near the injection point resulting in the formation of nearly spherical particles with a diameter ranging from approximately 0.5 to 10 mm in diameter. The hot tar/water slurry is then conducted to a heat exchanger, where the temperature is reduced resulting in the hardening of the tar pellets. In this process, a large volume of water is used to avoid hot tar particle to hot tar particle contacting that could result in the formation of a large number of odd shaped particles. The tar pellets are separated from the water by filtration and then coated with a polymer containing material that is insoluble in the DAO/AGO mixture using any known method in the art.

The coated SDA tar pellets are then added back into the DAO/AGO mixture and the resulting slurry is then transported by pipeline and/or ship to one or more refineries. The coating material is selected and tested to assure that the numerous inter-particle collisions do not result in failure of the coating. As a result, the viscosity of the slurry has not increased passed pipeline or shipping specifications.

At the refinery, the SDA tar pellets are separated from the DAO/AGO mixture and blended directly into the coker feed. The selected polymer coating cokes along with the SDA tar and does not interfere with any subsequent treatment of the coker products. The DAO/AGO mixture contains less metals than the starting extra heavy oil and thus is easier to refine.

Example 3

Using substantially the same procedure described in Example 2, the hot density adjusted SDA tar/inert gas mixture is instead injected into a pressurized hot water stream containing suitable water soluble or dispersed coating material; such as a dispersion of poly(methylmethacrylate) in water. The coated particles are then separated from the hot water, dried, and then dispersed into the DAO/AGO stream to create a transportable asphaltene slurry. The advantage of Example 3 over Example 2 is that less hot water is used in the process and the water stream does not need to be heated and cooled.

Example 4

Using substantially the same procedure described in Example 2, the hot density adjusted SDA tar/inert gas mixture is instead sprayed into heated air to produce droplets of hot tar with a particle size ranging from approximately 0.5 to 10 mm in diameter. The oxygen in the hot air cross-links the asphaltene molecules on the surface of the pellet to produce a pellet that does not dissolve into the DAO/AGO steam to any sizable extent.

Example 5

Following substantially the same procedure described in Example 2 the hot density adjusted SDA tar/inert gas mixture is sprayed into a plasma containing oxygen resulting in rapid and effective cross-linking of the surface asphaltene molecules on the pellet. As a result the pellet does not dissolve to any extent into the DAO/AGO mixture during transport.

Example 6

The hot density adjusted SDA tar is extruded downward through a large bank of holes into a cooling bath of water. The resulting hardened particles are then cracked through a roller, and then coated, prior to slurring into the DAO/AGO mixture. The resulting slurry, while slightly more difficult to pump than more conventional rounded pellets, has the advantage that the extrusion process that produces rods rather than pellets can be more easily scaled to large oil field applications.

Example 7

Using substantially the same procedure described in Examples 2-6, the asphaltene slurry is received at the refinery and after desalting is sent to a furnace to bring the temperature of the slurry to at least 160° C. The hot slurry is added to a stirred tank, where the SDA tar pellets melt and re-dissolve and/or re-disperse back into the DAO/AGO mixture to recreate the whole crude. The extra heavy oil is then treated like an ordinary extra heavy crude oil in the refining process.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

What is claimed is:

1. A method for handling asphaltene-containing liquid crude hydrocarbon feedstock, the process comprising:

solvent deasphalting at least a portion of the asphaltene-containing liquid crude hydrocarbon feedstock to form an asphaltene fraction and a deasphalted oil (DAO) fraction essentially free of asphaltenes;

adjusting the density of the asphaltene fraction to substantially the same density as the density of a carrier for the asphaltene fraction by forming gas encapsulated asphaltene particles with a nozzle having a means for supplying gas and a means for supplying the asphaltene fraction in a pressure chamber which surrounds the means for supplying the gas, wherein the density of the asphaltene fraction is within about 10% of the density of the carrier for the asphaltene fraction, and wherein the gas is trapped in the asphaltene fraction;

forming coated asphaltene particles from the gas encapsulated asphaltene particles;

mixing the coated asphaltene particles with a carrier to form a slurry; and transporting the slurry to a treatment facility or a transportation carrier.

2. The method of claim 1, wherein the asphaltene-containing liquid crude hydrocarbon feedstock comprises a heavy crude oil, extra heavy crude oil or residuum thereof.

3. The method of claim 1, wherein the step of adjusting the density of the asphaltene fraction to form gas encapsulated asphaltene particles comprises introducing a supply of a gas to the asphaltene fraction for a time period sufficient to adjust the density of the asphaltene fraction to within about 10% of the density of the carrier for the asphaltene fraction.

4. The method of claim 3, wherein the gas comprises one or more of air, argon, carbon dioxide, nitrogen, methane, and natural gas.

5. The method of claim 1, wherein the carrier is selected from the group of deasphalted oil (DAO) fraction, a blend of DAO with fractionated residue, a blend of DAO and naphtha, and wastewater.

6. The method of claim 1, wherein the density of the asphaltene fraction is adjusted to within about 5% of the density of the carrier for the asphaltene fraction.

7. The method of claim 1, wherein the density of the asphaltene fraction is adjusted to within about 3% of the density of the carrier for the asphaltene fraction.

8. The method of claim 1, wherein the coated asphaltene particles are in the form of pellets or rods.

9. The method of claim 1, wherein the step of forming coated asphaltene particles comprises: extruding the density adjusted asphaltene fraction to form asphaltene rods; and applying a coating to the asphaltene rods.

10. The method of claim 1, wherein the coating of the coated asphaltene particles is derived from a coating comprising poly(methylmethacrylate), coker fines, sulfur, clay, silica and mixtures thereof.

11. The method of claim 1, wherein the coating of the coated asphaltene particles is derived by contacting the asphaltene particles with a hot blast of an oxygen-containing gas sufficient to oxidize the outer surface of the asphaltene particles and form a coating thereon.

12. The method of claim 1, wherein the step of slurrying the coated asphaltene particles with the carrier comprises mixing the coated asphaltene particles with the DAO fraction.

13. The method of claim 1, further comprising the step of fractioning the asphaltene-containing liquid crude hydrocarbon feedstock by atmospheric distillation or vacuum distillation prior to solvent deasphalting at least a portion of an asphaltene-containing liquid crude hydrocarbon feedstock, generating fractionated residue.

14. The method of claim 13, wherein the fractionated residue is reintroduced into the DAO fraction.

15. The method of claim 1, wherein the step of transporting the slurry comprises transporting the slurry through a pipeline or on a ship.

16. The method of claim 1, wherein the nozzle is a concentric spray nozzle.

17. The method of claim 16, wherein the nozzle comprises an inner cylindrical tube for supplying the gas.

* * * * *